United States Patent [19]

Monte

[11] 4,296,817

[45] Oct. 27, 1981

[54] FIRE SUPPRESSION SYSTEM FOR MILITARY TANKS

[75] Inventor: Anthony J. Monte, Utica, Mich.

[73] Assignee: The United States of America as represented by the Secretary of the Army, Washington, D.C.

[21] Appl. No.: 91,423

[22] Filed: Nov. 5, 1979

[51] Int. Cl.[3] ..... A62C 35/12

[52] U.S. Cl. ..... 169/62; 180/9.2 R; 169/61

[58] Field of Search ..... 169/61, 62, 54, 56, 169/19, 28; 137/68 A, 72

[56] References Cited

U.S. PATENT DOCUMENTS

| | | | |
|---|---|---|---|
| 2,563,837 | 8/1951 | Grant, Jr. | 169/62 |
| 3,688,846 | 9/1972 | Leage | 169/62 |
| 3,993,195 | 11/1976 | Stevens et al. | 169/61 |
| 4,194,571 | 3/1980 | Monte | 169/61 |

*Primary Examiner*—Robert J. Spar
*Assistant Examiner*—Kenneth Noland
*Attorney, Agent, or Firm*—Peter A. Taucher; John E. McRae; Nathan Edelberg

[57] ABSTRACT

Mechanism for suppressing fires in military vehicles, especially in engine compartments and in relatively inaccessible areas beneath the turret-basket units of such vehicles. The mechanism includes a plurality of fire condition sensors for energizing an alarm device and/or an electric switch that controls the discharge of fire suppressant vapor toward the developing fireball. The system is flexible in that it provides for automatic suppression of near-explosive fires and manual suppression of slow growth fires.

The invention described herein may be manufactured, used, and licensed by or for the Government for governmental purposes without payment to me of any royalty thereon.

1 Claim, 5 Drawing Figures

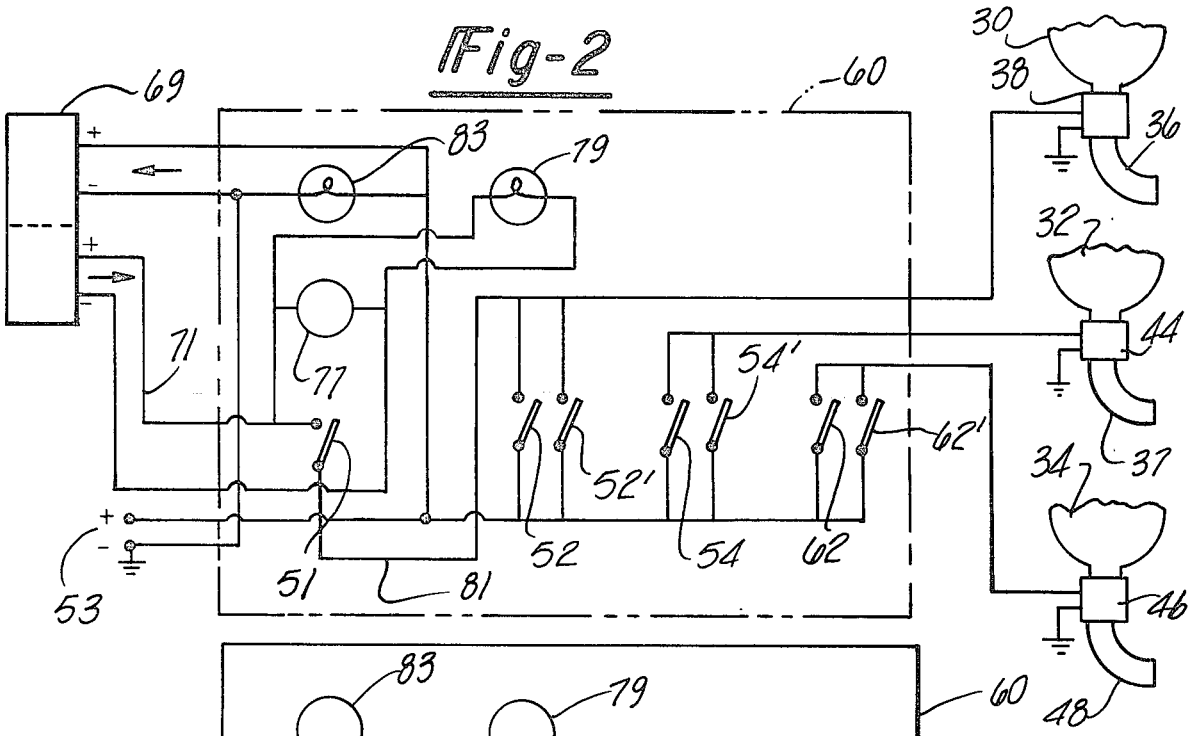
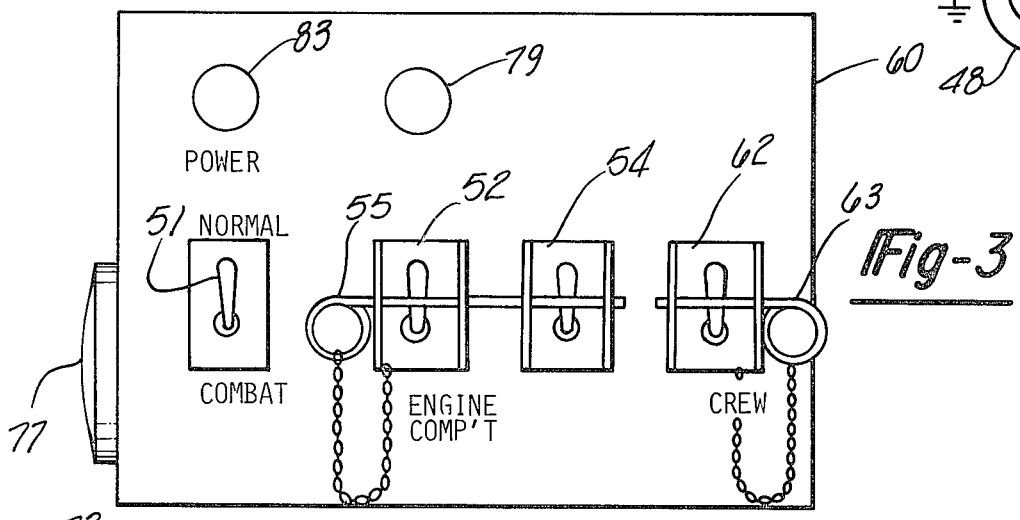
Fig-3
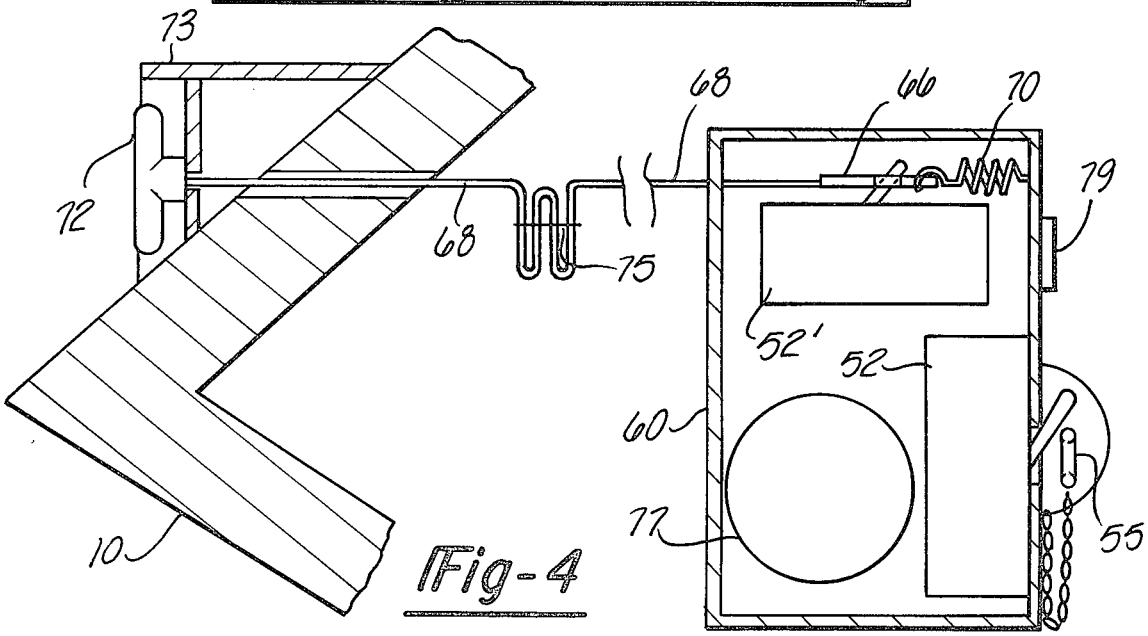
Fig-4

FIRE SUPPRESSION SYSTEM FOR MILITARY TANKS

BACKGROUND AND SUMMARY OF THE INVENTION

This invention relates to a fire suppression system for military tanks. Some of the mechanical components used in my invention are functionally similar to components used in my other invention, described in U.S. Patent application Ser. No. 014,502 filed Feb. 23, 1979, now U.S. Pat. No. 4,194,571. The present arrangement differs from the earlier described mechanism in that it provides a system of sensors, switches and alarms which enable fires to be suppressed automatically (no human assistance) or manually, as by actuation of an electric switch. Such "automatic-manual" flexibility is desirable in order to better handle different types of fires, ranging from near-explosive fires generated by passage of enemy projectiles through engine fuel tanks to slow-growth fires associated with fuel leaks or spills, electrical arcing, heater malfunction, debris accumulation, improperly secured electrical cables, and loose electrical connections.

During peace time periods there is a reduced need for responding to near-explosive fires associated with enemy action. Therefore I provide a manual switch for selectively placing the electrical control system in a normal "peacetime" mode or a combat mode. In the normal peacetime mode an electrically-triggered discharge valve for each fire-suppressant bottle is controlled manually, as by means of a switch at the driver's station. In the combat mode at least some of the electrically-triggered discharge valves are controlled by automatic fire sensor devices, thus freeing the troops for combat activities.

THE DRAWINGS

FIG. 2 is an electric diagram of a circuit for controlling fire suppressant valves in the FIG. 1 embodiment.

FIG. 3 is a front view of a cabinet for containing components of the FIG. 2 circuitry.

FIG. 4 is a transverse sectional view taken through the FIG. 3 cabinet.

Figure 1:
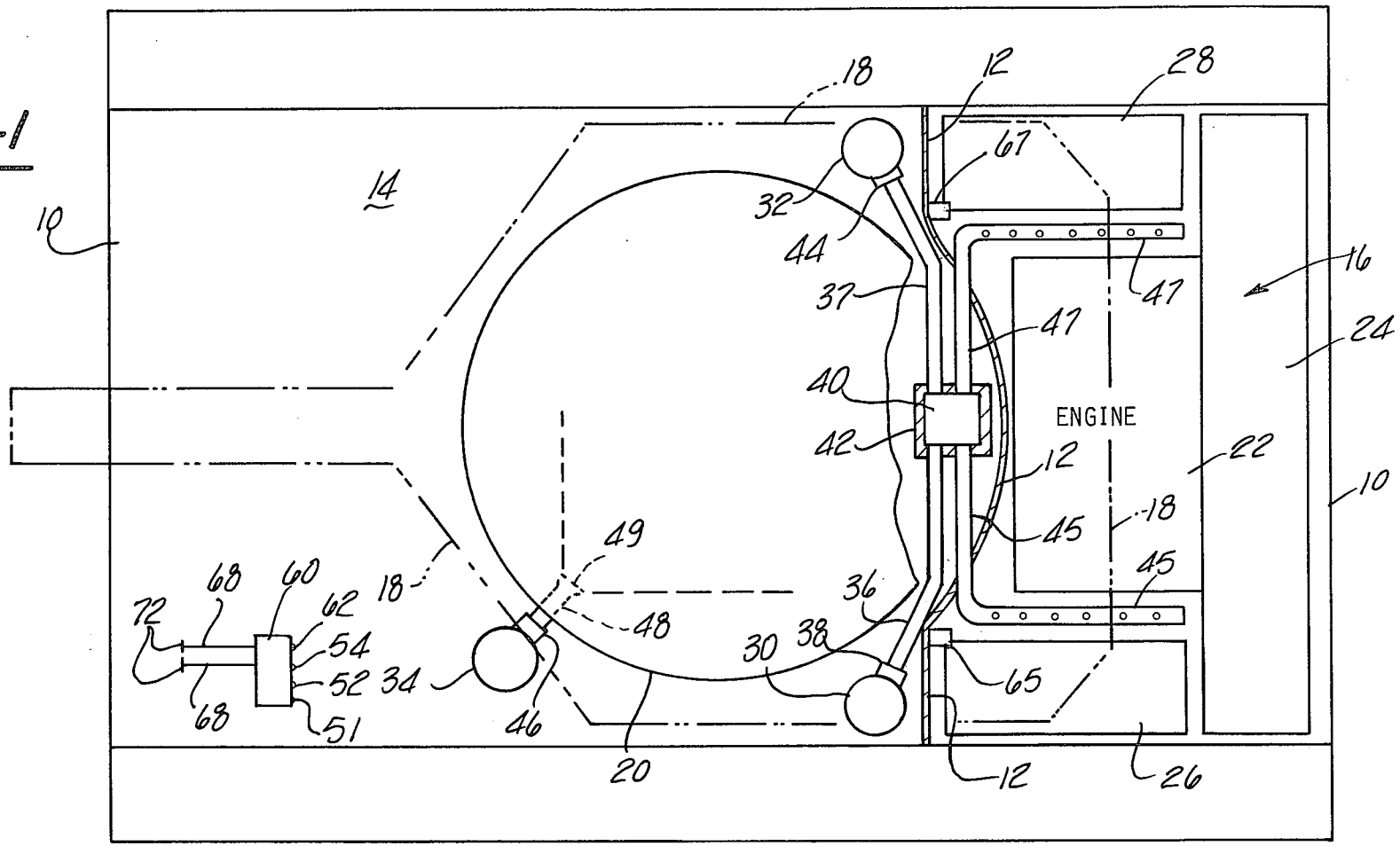
FIG. 1 is a schematic top plan view of a conventional military tank incorporating one embodiment of my invention therein.

Referring in greater detail to the drawings, there is shown in FIG. 1 a conventional military tank that includes a hull 10 having an internal bulkhead 12 that subdivides the hull interior space into a forward driver-basket space 14 and a rearward engine compartment 16. A gun-mounting turret 18, shown in phantom lines, is rotatably positioned at a central point on the hull for three hundred sixty degree movement in the azimuth plane; suspended from the turret is a circular basket or cage 20. Normally this basket is about eight feet in diameter, sufficient for accommodating at least the commander and gunner. The floor of the basket is located only a small distance above the hull floor in order to provide maximum personnel space within the basket. The engine compartment 16 provides space for a turbine or piston engine 22, transmission 24 and two fuel tanks 26 and 28.

The present invention is directed to means for suppressing fires in engine compartment 16 and in the confined space below the lower surface of basket 20. Concern for the space beneath basket 20 is due to the fact that this space is not readily accessible for clean-out of spilled oil or debris. This space usually contains slip rings, cables and hydraulic lines for supplying power to the gun sights, gun elevating systems, and other power-using equipment within the turret. Due to vehicle design oil tends to drain into the confined space where it is susceptible to being ignited by electrical sparking or soakage of the electrical cable insulation or stray tools, etc. Use of manual portable fire extinguishers to cover the space beneath basket 20 is not completely satisfactory because the space is only a few inches high, thus not readily accessible. I prefer to employ a manually controlled fire-suppressant bottle permanently targeted on the sub-basket space.

With respect to the engine compartment 16, there is concern for slow-growth fires due to fuel and hydraulic oil leakage or ruptures at the various tube connections, joints and seams. An additional concern is near-explosive fires associated with passage of enemy projectiles through fuel tanks 26 and 28. The explosive fire problem is discussed in various patents, as for example U.S. Pat. No. 3,915,237 to E. Roznieck, U.S. Pat. No. 3,930,541 to Bowman et al., U.S. Pat. No. 4,132,271 to J. Mikaila. Treatment of explosive type fires is best handled by automatic fire suppressant systems wherein the suppressant vapor is discharged toward the fireball within a few milliseconds after initial generation of the fireball, i.e. before the fireball is too large to be contained; manually-controlled systems are generally considered too slow-acting to be effective against explosive-type fireballs.

The fire suppressant system shown in FIG. 1 comprises three upright pressure-resistant bottles or cylinders 30, 32 and 34, each pre-charged with a vaporizable fire suppressant or extinguishant agent, such as Halon 1301 ($CF_3Br$), and supercharged with an expelling agent such as dry nitrogen; the bottle pressure is preferably in the vicinity of about 700–800 p.s.i. for reasons mentioned in U.S. Pat. No. 3,915,237.

Bottle 30 is connected to a electrically-operated or squib-actuated type valve 38, preferably constructed as shown in U.S. Pat. No. 3,491,783 to O. Linsalato. The outlet opening from valve 38 communicates with a tube or pipe 36 that leads to a chamber 40 defined by manifold 42. The manifold may be disposed within the clearance space between the floor of basket 20 and the hull floor. Bottle 32 is connected to a second electrically-operated valve 44, similar to valve 38. Valve 44 communicates with manifold chamber 40 through a tube or pipe 37.

Chamber 40 communicates with two similar pipes or tubes 45 and 47 that extend through bulkhead 12 and into the spaces between engine 22 and fuel tanks 26 and 28. Each pipe is provided with perforations or ports therealong for discharge of suppressant vapor into the engine-fuel tank space.

In operation of the described fire-suppressant mechanism, electric actuation of the first-mentioned valve 38 enables pressurized suppressant to flow from bottle 30 into manifold 40, thence through tubes or pipes 45 and 47 into the engine compartment; similarly electrical actuation of valve 44 enables pressurized suppressant to flow from bottle 32 into manifold 40 and thence through tubes 45 and 47 out into the engine area. Check valves, not shown, may be employed to prevent flow of pressurized suppressant from one bottle to another.

The third-mentioned bottle 34 is provided with an electrically-operated valve 46, preferably constructed similarly to the valve shown in aforementioned U.S. Pat. No. 3,491,783. A discharge pipe 48 extends from the valve into the space beneath basket 20 (i.e. between the lower surface of the basket and the hull floor) to deliver pressurized suppressant to a spray nozzle 49; preferably the nozzle has a wide angle spray pattern, sufficient to cover the area beneath basket 20. It is intended that the driver of the vehicle will operate valve 46 to the flow-open position by manual actuation of an electric toggle switch 62 located in a cabinet 60. Cabinet 60 is preferably disposed near the front (nose) end of the hull within reach of the driver. The driver is located close to basket 20 such that his physical senses (eyesight or smell) alert him to the danger of fires initiating in the space beneath the basket.

FIG. 2 schematically illustrates an electrical system for manually triggering the three valves 38, 44 or 46. The electrical system also includes circuitry for triggering two of the valves automatically in response to electrical signals developed at one or more fire sensors located in the engine compartment (assuming a manual control switch 51 is first set at its combat position).

Manual actuation of the three valves 38, 44 or 46 from within the vehicle is accomplished by closure of switches 52, 54 or 62; each of these switches is located in an electrical line leading from a source of positive voltage 53 to the respective valve actuator. As best shown in FIG. 3 these switches are protected against accidental tripping by safety pins 55 and 63.

In some instances a fire may immediately threaten the safety of the vehicle occupants, in which case they may elect to exit the vehicle prior to manual actuation of the fire suppressant control switches. In other instances a fire might break out when the vehicle is unoccupied. In either event it may be desirable that the control switches be operated from a location external to the vehicle hull 10. As shown in FIG. 4, external switch-actuation capability is provided by a toggle switch 52' whose operating lever extends through an apertured plate 66 that is connected to a cable 68 and tension spring 70. The cable extends through hull 10 to a small handle 72 located within a hood 73. A pulling action on handle 72 actuates switch 52 to a circuit-closed condition for electrically energizing valve 38. An intermediate section of cable 68 may be coiled or looped, and bound up by means of a breakable safety wire 75. A pulling action on handle 72 breaks wire 75, takes up slack in the cable system, and actuates switch 52; at the same time the soldier is able to move away from the burning vehicle. Use of the coil feature is optional.

FIG. 4 illustrates external actuation capability for valve 38 (via switch 52'). External actuation capability may also be provided for valves 44 and 46, as by means of switches 54' and 62' (FIG. 2). The three externally-actuable switches 52', 54' and 62' may be provided with individual plates 66 and pull handles 72. Alternately two or more of the switches may be connected to a single plate 66 and pull handle 72, whereby operation of a single handle actuates two or more switches and thus two or more fire suppressant valves. Use of a single handle 72 for gang type actuation of two or more switches may be desirable since the soldier may not have time to investigate the exact location of the fire within the vehicle. It may be desirable for the soldier to pull a single available handle and thus achieve a complete fire-suppression action in the shortest possible time.

Ordinarily it would be expected that a fire would break out with the vehicle occupied. The driver can detect slow growth fires in the crew compartment (merely by his sense of sight or smell) in time to operate switch 62. However fires in engine compartment 16 are not readily apparent to the driver or other crew members. FIG. 1 schematically illustrates two electro-optic fire sensors 65 and 67 located on bulkhead 12 to detect fires initiated in the spaces between engine 22 and the fuel tanks 26 and 28 (the most likely sites for near-explosive or slow-growth fires). These detectors are electrically constructed as component parts of a logic/control unit designated generally by numeral 69 in FIG. 2. Control unit 69 includes two sensors 65 and 67, each optically responsive to infra-red emissions associated with hydro-carbon flame, together with an amplifier, as described generally in U.S. Pat. No. 3,825,754 issued to Cinzori et al. Suitable logic/control units are available from Santa Barbara Research Center under its designation PM-34. The output of control unit 69 is applied through line 71 to an audible alarm 77 and optically visible lamp alarm 79. Thus, at the onset of a flame in the engine compartment there will be both an audible and visible alarm signal at cabinet 60, whereby the driver can operate switch 52 or switch 54 to extinguish the flame. Switch 52 is arbitrarily designated the primary switch, and switch 54 is arbitrarily designated the secondary or back-up switch. Therefore the driver would initially operate switch 52; if alarm 77 and 79 remained on, or came back on, the driver would operate switch 54 to suppress the initial flame or any re-ignition flame.

Should an enemy projectile pass through either fuel tank 26 or 28 the resultant flame will expand in near-explosive fashion. It is not believed possible to suppress or control explosive fires manually, as by operation of switches 52 or 54. Howevern when switch 51 is pre-set to its "combat" closed position a potential energizer circuit for valve 38 is established across lines 71 and 81. Therefore, should either sensor 65 or 67 sense the presence of an explosive flame in the engine compartment an electrical signal is instantaneously transmitted from control unit 69 through line 71, switch 51 and line 81, to trigger valve 38 to the open condition; hopefully the flame should be suppressed within less than one half a second.

It is desirable that the driver have some assurance that control unit 69 and the various switches are operational for fire sensing/suppression purposes. Accordingly, there may be provided in cabinet 60 at least one "power on" indicator lamp 83. As shown, lamp 83 is connected to indicate that power is being supplied to control unit 69 and the various manual switches 52, 52', 54, 54', 62 and 62'.

Summarizing operation of the described fire-suppression system, when switch 51 is in the closed "combat" position near-explosive fires in engine compartment 16 are automatically extinguished by sensors 65 and 67, acting to energize control unit 69 and valve 38 for fire suppressant bottle 30. The existence of an explosive fire or slow growth fire in the engine compartment is communicated to the driver through alarms 77 and 79. Switches 52, 54 and 62 provide the driver with a capability for controlling slow growth fires from within the vehicle. Switches 52', 54' and 62' provide a capability for controlling vehicle fires from a point outside the vehicle. The system offers a flexible approach toward the handling of different type fires initiating in the engine compartment or crew compartment, especially in the relatively inaccessible area beneath the turret basket.

The FIG. 1 system uses a manifold 42 to permit either bottle 30 or 32 to supply pressurized fire suppressant to both of the apertured pipes 45 and 47. This arrangement gives a two shot capability in both outboard areas of the engine. If bottle 30 is unable to suppress the fire then bottle 32 can be called upon as a backup. However, the manifolding feature is disadvantageous in that it tends to increase the length of piping between each bottle and the apertured pipe 45 or 47, thus undesirably increasing the elapsed time between opening of the respective valve and application of fire suppressant to the flame area. In the case of near-explosive fires the relatively long time lapse due to suppressant travel might in some instances enable the flame to propagate beyond manageable proportions. The suppressant travel time may be reduced by use of the system shown in FIG. 5.

Figure 5:
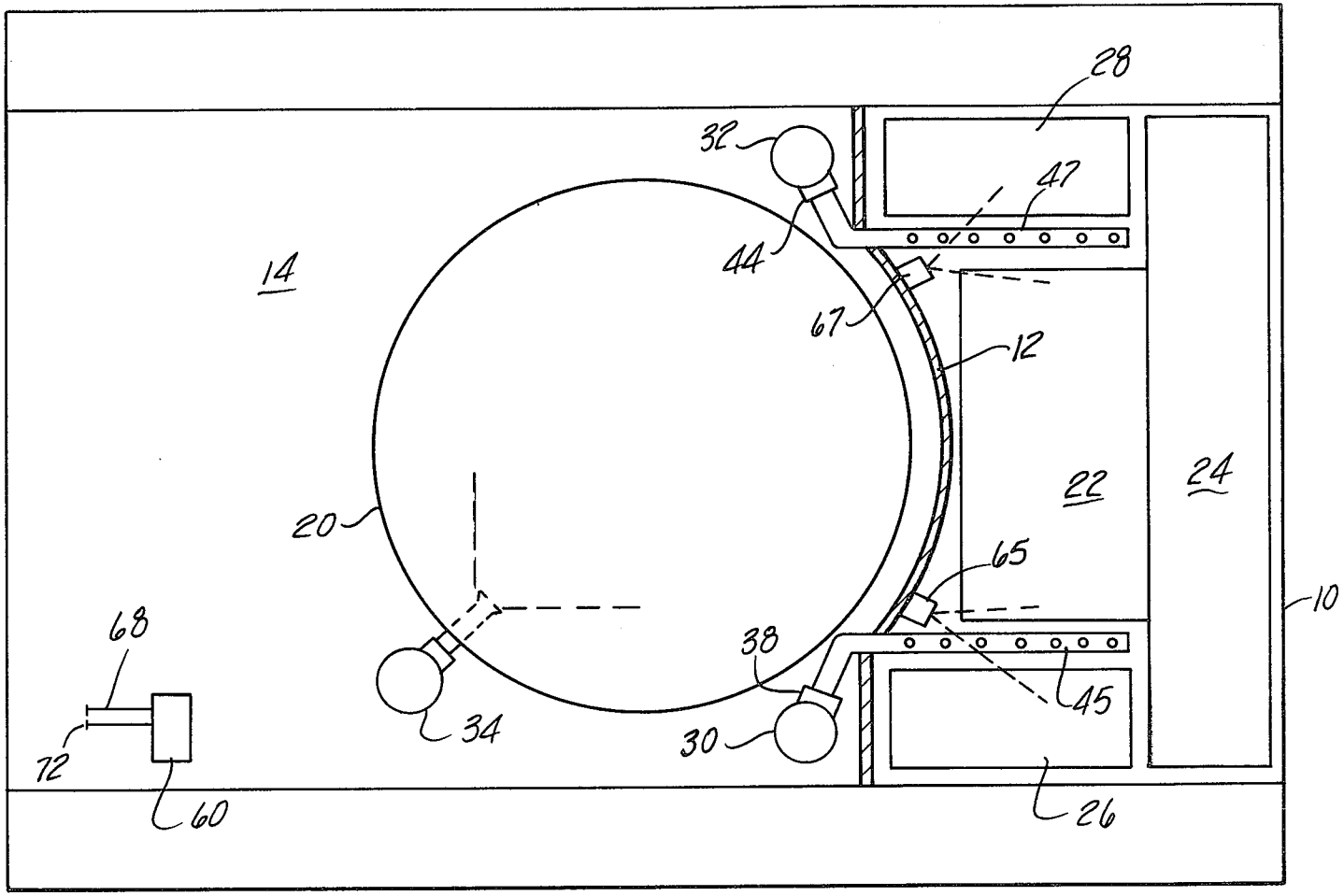
FIG. 5 illustrates a military tank having a second embodiment of my invention.

In the FIG. 5 system each bottle 30 or 32 is connected directly to an apertured pipe 45 or 47 without an intervening manifold; the suppressant travel time, from bottle to atmosphere, is appreciably reduced. Since each bottle services only one of the outboard sides of the engine it is preferred to use an electrical control system wherein each sensor triggers only that valve (38 or 44) for its particular target area. Thus, sensor 65 controls valve 38, whereas sensor 67 controls valve 44. The FIG. 5 system does not have a two shot capability, but it does not have the advantage of decreased suppressant travel time. The FIG. 5 system provides a greater concentration and duration of suppressant discharge to a given target area because each bottle services only one area; the contents of each bottle are not required to be apportioned to different target zones.

The FIG. 1 and FIG. 5 systems are intended to provide flexible fire suppression methods, wherein slow growth fires can be controlled manually from inside or outside the vehicle, and near-explosive fires can be controlled automatically. Manual control is advantageous in minimizing false triggering, false alarms or unnecessary discharge of the bottle contents. Automatic control of explosive fires is necessary when vehicle mobility is threatened by enemy action.

I wish it to be understood that I do not desire to be limited to the exact details of construction shown and described for obvious modifications will occur to a person skilled in the art.

I claim:

1. In a military tank, a hull having an internal bulkhead defining a driver compartment and an engine compartment, a rotary turret carried by the hull, and a man-accommodating basket depending from the turret into the drive compartment; the improvement consisting of means for suppressing fires in the engine compartment or in the hull space beneath the basket; said fire-suppressing means comprising first, second and third pressure-resistant bottles positioned in the driver compartment; vaporizable pressurized fire-suppressant charged into each bottle; first conduit means oriented to discharge first bottle suppressant into the engine compartment; a first electrically-operated valve for controlling flow through the first conduit means; second conduit means oriented to discharge second bottle suppressant into the engine compartment; a second electrically-operated valve for controlling flow through the second conduit means; third conduit means oriented to discharge third bottle suppressant into the hull space beneath the basket; a third electrically-operated valve for controlling flow thorugh the third conduit means; a cabinet located in the hull within reach of the human driver; first, second and third manual switches located in the cabinet for actuation by the driver to trigger respective ones of the valves to their open conditions; flame-responsive sensor means for detecting the occurrence of a fireball in the engine compartment; an alarm device located in the cabinet and energizable by said sensor means to alert the driver to the presence of a fire in the engine compartment; an electrical circuit operated by the sensor means to trigger at least one of the first and second valves to the open condition, whereby fires in the engine compartment can be suppressed automatically or under manual control, and fires in the hull space beneath the basket can be suppressed under manual control; fourth, fifth and sixth manual switches located within the cabinet in electrical parallelism with respective ones of the first, second and third switches; and a cable operator for each of the fourth, fifth and sixth switches; each cable operator being accessible from a point external to the hull; each of the fourth, fifth and sixth switches being a toggle switch having a lever operator; each cable operator including an apertured element (66) and a tension spring (70); each apertured element having one of its ends thereof connected to a cable and its other end connected to a spring; each spring being anchored within the aforementioned cabinet to draw the associated toggle switch to a circuit-open position.

* * * * *